US006335588B1

(12) United States Patent
Kim et al.

(10) Patent No.: US 6,335,588 B1
(45) Date of Patent: Jan. 1, 2002

(54) CATHODE RAY TUBE

(75) Inventors: Do-nyun Kim; Bong-woo Lee, both of Suwon-si (KR)

(73) Assignee: Samsung Display Devices Co., Ltd., Kyungki-Do (KR)

( * ) Notice: Subject to any disclaimer, the term of this patent is extended or adjusted under 35 U.S.C. 154(b) by 0 days.

(21) Appl. No.: 09/287,594

(22) Filed: Apr. 6, 1999

(30) Foreign Application Priority Data

Oct. 1, 1998 (KR) ..... 98-41356

(51) Int. Cl.[7] ..... H01J 29/80
(52) U.S. Cl. ..... 313/402; 313/407; 313/408
(58) Field of Search ..... 313/402, 403, 313/407, 408, 461, 477 R

(56) References Cited

U.S. PATENT DOCUMENTS 3,731,129 A 5/1973 Tsuneta et al. ..... 313/64

FOREIGN PATENT DOCUMENTS

EP 0810627 A2 * 12/1997
JP 9-320492 12/1997

* cited by examiner

*Primary Examiner*—Michael H. Day
*Assistant Examiner*—Joseph Williams
(74) *Attorney, Agent, or Firm*—Christie, Parker & Hale, LLP

(57) ABSTRACT

A cathode ray tube includes a rectangular panel having a phosphor screen formed thereon, a neck having an electron gun assembly disposed therein for emitting three electron beams and a funnel. The funnel has a body portion and a cone portion wherein a contour of the cross-section of the cone portion is a non-circular shape and the perpendicular distance from the tube axis to the contour occurs in the substantially diagonal direction with an angle θ' with respect to the horizontal axis according to the following inequality $\theta-(4.3+(S/3.8))<\theta'<\theta+(4.3+(S/3.8))$, where θ is the angle in degrees between the diagonal of the face panel and the horizontal axis; S is the distance in mm between the centers of the electron passing holes of the electron gun assembly.

3 Claims, 3 Drawing Sheets

CATHODE RAY TUBE

BACKGROUND OF THE INVENTION

The present invention relates to a cathode ray tube (CRT) and more particularly, to a cathode ray tube capable of reducing the power consumption and preventing deflection magnetic fields from leaking to the outside of the cathode ray tube.

DESCRIPTION OF THE RELATED ART

A CRT is a device for displaying an image on a screen by vertically and horizontally deflecting electron beams generated from an electron gun and landing the deflected electron beams onto the phosphor layers formed on the screen. The deflection of the electron beam is controlled by a deflection yoke mounted on an exterior surface of a funnel of the CRT and which forms vertical and horizontal magnetic fields. The CRTs are generally employed for color televisions (TVs), monitors and high definition televisions (HDTV). And with the increasing use of CRTs, there is a need to reduce the length of the CRT for increasing brightness of the displayed image and for reducing the size of the final products, such as TVs, monitors and HDTVs.

When reducing the length of the CRT, the electron beams should be deflected with wide-angles, and the deflection frequency and current supplied to the deflection yoke should be increased for wide-angle deflections of the electron beams. As the deflection frequency and current increases, the deflection magnetic field tends to leak to the outside of the cathode ray tube and the power consumption increases.

In order to decrease the magnetic field leakage, a compensation coil is generally mounted with the deflection yoke. When, however, the compensation coil is employed, the power consumption of the cathode ray tube increases. Alternatively, in order to decrease the deflection power and the magnetic field leakage at the same time, it is conventionally preferable to decrease the neck diameter of the cathode ray tube and the outer diameter of the funnel near the neck side on which the deflection yoke is mounted, so that the deflection field efficiently acts on the electron beams. However, when the neck diameter is simply decreased, there are some disadvantages including the resolution of the image deteriorating due to the reduced diameter of the electron gun, and the outer electron beams tending to bombard the inner wall of the funnel, thus results in that the bombarded electron beams are not properly landed on the phosphor layer of the screen.

In order to solve these problems, U.S. Pat. No. 3,731,129 discloses a funnel having a wider peripheral portion sealed to the periphery of the panel, and a deflection portion whose cross-sectional configuration gradually varies, from a rectangular shape substantially similar to that of the rectangular image produced on the panel to a circular shape. Thereby, the vertical and horizontal coils of the deflection yoke are more proximately located to the passage of the electron beams, and deflect the electron beams with reduced deflection power and without bombarding the electron beams to the inner wall of the funnel.

However, if the funnel having rectangular cross-section is designed without precisely considering the passage of the electron beams, the deflection magnetic fields generated by the deflection yoke cannot effectively deflect the electron beams, and the power consumption and the deflection magnetic field leakage cannot be minimized.

To overcome these shortcomings, Japanese Laid Open Patent 9-320492 discloses a funnel, whose cross-section of the exterior surface at the neck side changes from a circular shape to a non-circular shape which has a maximum diameter along a direction (diagonal direction) other than the horizontal axis and the vertical axis. The angle between the diagonal direction and the horizontal axis changes according to the distance from the electron gun. The Japanese Patent discloses that the CRT having such funnel can reduce the deflection power and the magnetic field leakage by mounting the deflection yoke at the position nearest to the passages of the electron beams.

However, the exterior shape of the funnel on which the deflection yoke is mounted is designed without precisely considering the passages of the electron beams and the S-value (i.e., the distance between the holes of the electron gun through which the electron beams pass) by which the convergence and focusing characteristics of the electron beams are changed.

SUMMARY OF THE INVENTION

Accordingly, an embodiment of the present invention is directed to a cathode ray tube which substantially obviates one or more of the problems due to the limitations and disadvantages of the related art.

An object of an embodiment of the present invention is to provide a cathode ray tube capable of minimizing the power consumption and preventing deflection magnetic fields from leaking to the outside of the cathode ray tube.

Another object of an embodiment of the present invention is to provide a cathode ray tube having a funnel whose exterior surface is designed similar to the passage of the electron beams.

Further object of an embodiment of the present invention is to provide a cathode ray tube particularly suitable for flat-panel cathode ray tube.

To accomplish these and other advantages, an embodiment of the cathode ray tube of the present invention includes a rectangular panel on which a phosphor screen is formed, a neck in which an electron gun assembly for emitting three electron beams is disposed and a funnel. The funnel which is comprised of a body portion and cone portion wherein a contour of the cross-section of said cone portion is a non-circular shape and the perpendicular distance from the tube axis to the contour occurs in the substantially diagonal direction which makes an angle $\theta$ with respect to the horizontal axis according to the following inequality $\theta-(4.3+(S/3.8))<\theta'<\theta+(4.3+(S/3.8))$ wherein $\theta$ is the angle in degree the diagonal of the face panel makes with respect to the horizontal axis; S is the distance in mm between the centers of the electron passing holes of the electron gun assembly.

The objectives and other advantages of the present invention will be realized and attained by the structure particularly pointed out in the written description and claims as well as the appended drawings. It is also to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate a particular embodiment of the invention and, together with the description, serve to explain the principles of the invention. In the drawings.

DETAILED DESCRIPTION OF THE INVENTION

The preferred embodiments of the present invention will be described with reference to the accompanying drawings.

Figure 1:
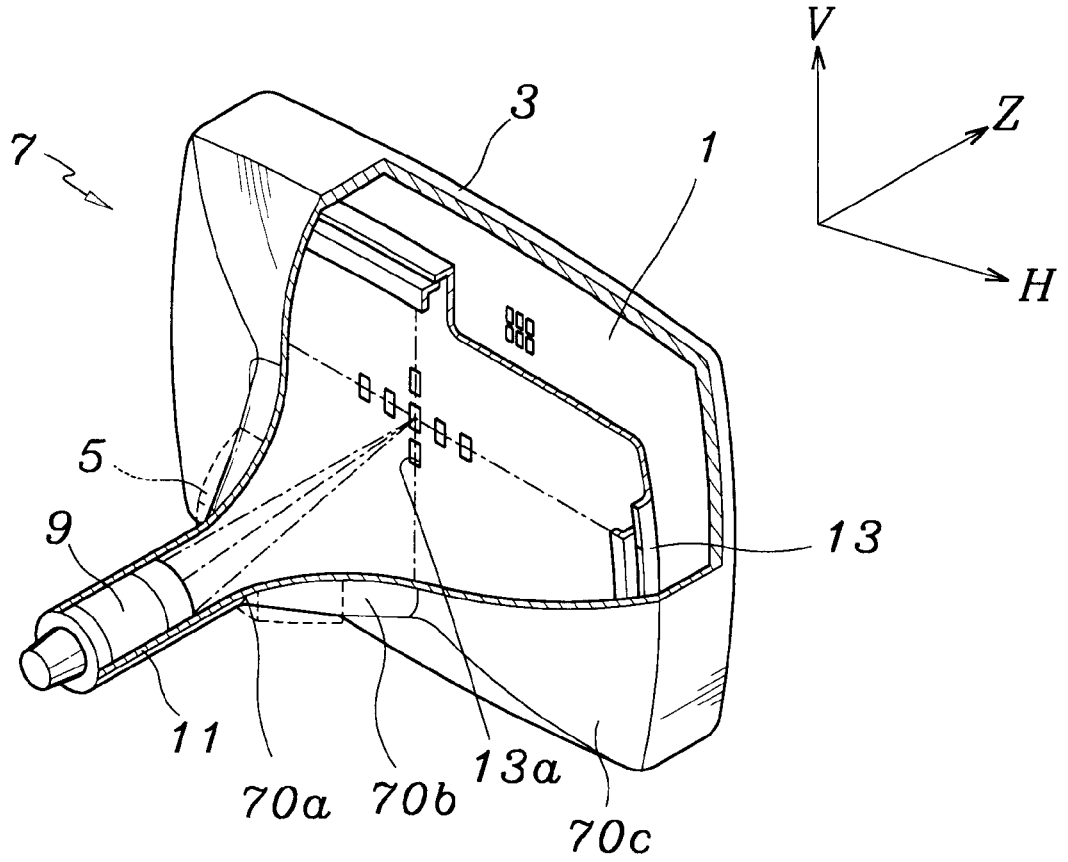
FIG. 1 is a partial sectional perspective view of a cathode ray tube according to an embodiment of the present invention.
Figure 2:
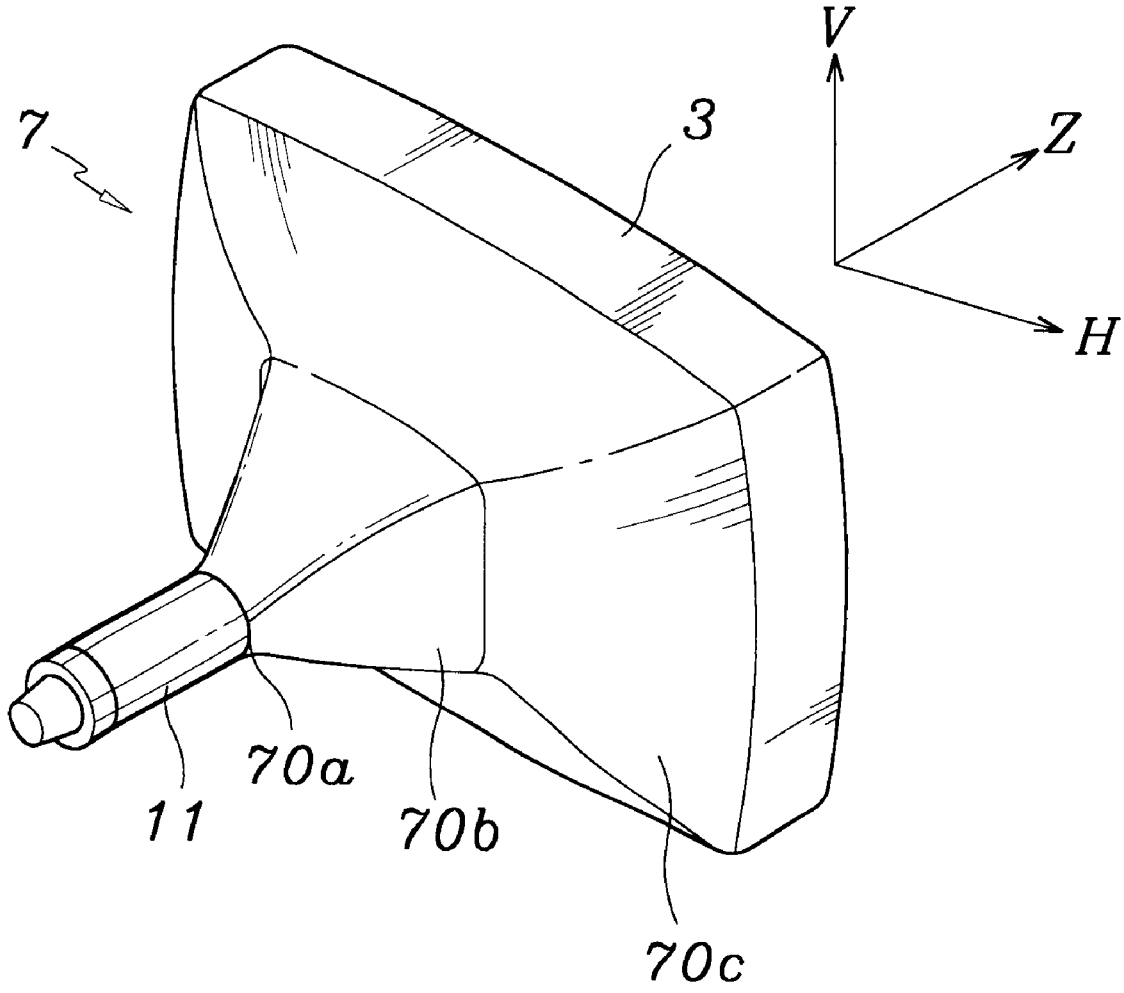
FIG. 2 is a perspective view of a cathode ray tube according to an embodiment of the present invention.

As shown in FIGS. 1 and 2, a CRT is a vacuumed envelope having a substantially rectangular face panel 3, a funnel 7 and a cylindrical neck 11. The face panel 3 has a phosphor layer 1 coated on its inner surface. It has a predetermined aspect ratio. A deflection yoke 5 is mounted on a portion of the funnel 7 near the neck 11, and an electron gun assembly 9 for emitting three electron beams is disposed in the neck 11. The three electron beams emitted from the electron gun assembly 9 are horizontally and vertically deflected by horizontal and vertical magnetic fields generated by the deflection yoke 5 and pass apertures 13*a* in a shadow mask 13 mounted on the inner surface of the face panel 3 before hitting the phosphor layer 1, which as the result, emits lights of different colors depending on the phosphor material used.

The funnel 7 is comprised of two rather distinct portions, a cone portion 70*b* and a body portion 70*c*, which are contiguously formed. The deflection yoke 5 is mounted on the cone portion 70*b*. And the novelty of an embodiment of the present invention lies in particular dimensional shapes of the cone portion 70*b* as described below.

The cone portion 70*b* has a circular cross-section at the point 70*a* where the cone portion is contiguously connected to the neck portion. The cross-sectional shape of the cone, however, gradually changes from circular to non-circular as they are taken toward the funnel body. When viewed directly behind the CRT, the perpendicular distance from the central axis of the tube to the contour of the cross-section is greatest in a substantially diagonal direction because the cross-sections would look more like a rectangle as they approach the funnel body. A cone portion having a cross-section which gradually becomes rectangular has an advantage of bringing the deflection magnetic fields, generated from the deflection yoke 5, closer to the passages of the electron beams.

Figure 3:
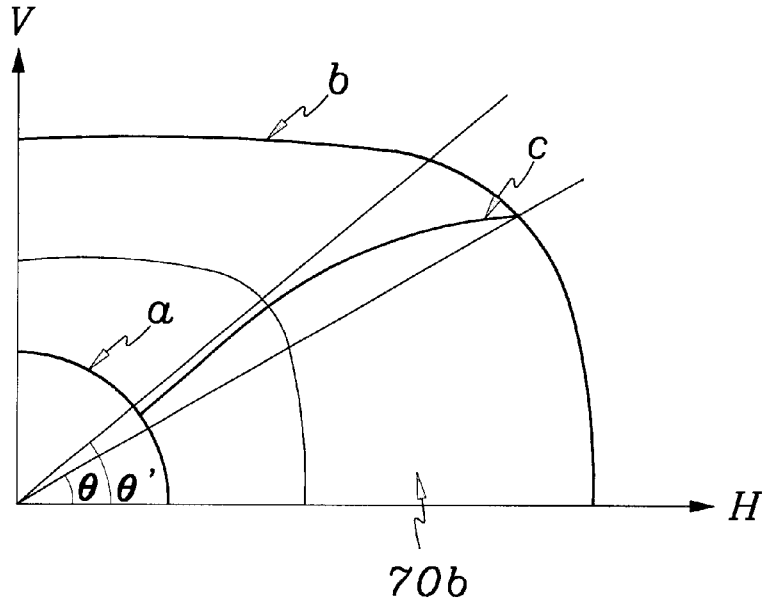
FIG. 3 is a graph for illustrating the shape of the cone part of a funnel according to an embodiment of the present invention.

FIG. 3 illustrates superposed cross-sections, marked by "a" and "b" of the cone portion at the point 70*a* where the cone portion starts and at the point where the cone portion ends, respectively. In the CRT of an embodiment of the present invention, the cone portion 70*b* is designed such that the maximum distance from the tube axis to the contour of the cross-section occurs in a substantially diagonal direction. Here the tube axis is an axis passing through the centers of the face panel 3 and the neck 11.

More specifically the cone portion 70*b* can be defined by the following, which represents an angle θ between the substantially diagonal direction of the non-circular cross-section and the horizontal axis:

$$\theta-(4.3+(S/3.8))<\theta'<\theta+(4.3+(S/3.8))$$

wherein θ is the angle in degrees between the diagonal of the face panel and the horizontal axis.

S is the distance in mm between the centers of the electron passing holes of the electron guns.

Figure 4:
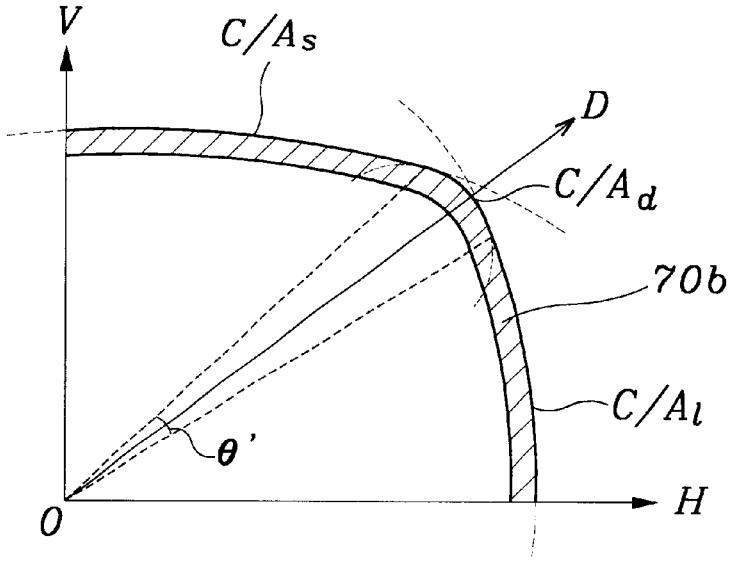
FIG. 4 is a partial sectional view of a cone part of a funnel according to an embodiment of the present invention.

FIG. 4 shows a cross-sectional view of a cone portion 70*b* in the first quadrant according to the present invention. The contour of the cross-section can be viewed as having three curvatures serially connected. The first curvature C/Al represents the side of the contour and second curvature C/As represents the top of the contour. The third curvature C/Ad is located between the first and second curvatures as illustrated in FIG. 4. More particularly, the third curvature should be present within the angle Δθ' between θ−(4.3+(S/3.8)) and θ+(4.3+(S/3.8)).

Experiments show that, with such cone portion as configured as above, the deflection yoke 5 can become closer to the passage of the electron beams resulting in efficient beam deflection so that deflection power consumption is reduced to the minimum.

Deflection power consumption of the CRTs with various configuration of the cone portion 70*b* was measured and results are shown in the following table for a CRT where the aspect ratio is 4:3, θ=36.87° and S=5.6 mm.

TABLE

| Test No. | 1 | 2 | 3 |
|---|---|---|---|
| θ' (°) | 36.87 | 39.0 | 41.0 |
| Deflection Power | 100% | 97.7% | 96.2% |

As shown in the Table, when the substantially diagonal axis of the cross-section of the cone portion 70*b* is located within ±(4.3+S/3.8)) of the face panel's diagonal angle θ, the deflection power consumption is reduced.

So far, description was made as to exterior surface of the funnel, more particularly the cone portion 70*b*. However, since the funnel of a CRT has a certain thickness, the interior surface of the cone portion preferably follows a similar configuration. In other words, the interior contour of the cross-section of the cone portion 70*b* also gradually changes from a circular shape at the neck to non-circular or substantially rectangular shape, to be specific, such that the maximum distance from the tube axis to the inner contour of the cross-section occurs in a substantially diagonal direction.

It will be apparent to those skilled in the art that various modifications and variations can be made in the embodiment of present invention without departing from the spirit or scope of the invention. Thus, it is intended that the present invention cover modifications and variations of this embodiment of the present invention provided they come within the scope of the appended claims and their equivalents. This application is based on application No. 98-41356 filed in Korean Industrial Property Office on Oct. 1, 1998, the content of which is incorporated herein by reference.

What is claimed is:

1. A cathode ray tube comprising:

a face panel having a phosphor screen;

a neck having an electron gun assembly disposed therein, said electron gun assembly including a plurality of electron passing holes; and a funnel comprising a body portion and a cone portion having a non-circular cross-section wherein a substantially diagonal line extending from a tube axis to the contour of the cone section makes an angle θ with respect to a horizontal axis according to the following inequality $$\theta-(4.3+(S/3.8))<\theta'<\theta+(4.3+(S/3.8));$$

wherein θ is an angle in degrees between a diagonal of the face panel and the horizontal axis, and S is a distance in mm between centers of the electron passing holes of the electron gun assembly.

2. The cathode ray tube of claim 1 wherein the contour is the outer contour of the cross-section.

3. The cathode ray tube of claim 1 wherein the contour is the inner contour of the cross-section.

* * * * *